US005724785A

United States Patent [19]

Malanowski

[11] Patent Number: 5,724,785

[45] Date of Patent: Mar. 10, 1998

[54] ARTICLE PACKAGING MACHINE WITH IMPROVED OVERHEAD FLIGHT ASSEMBLY

[75] Inventor: Don B. Malanowski, Marietta, Ga.

[73] Assignee: Riverwood International Corporation, Atlanta, Ga.

[21] Appl. No.: 660,432

[22] Filed: Jun. 7, 1996

[51] Int. Cl.[6] ..... B65B 21/00

[52] U.S. Cl. ..... 53/48.1; 53/252; 53/258; 53/259; 198/728

[58] Field of Search ..... 53/252, 258, 259, 53/543, 566, 48.1; 198/717, 725, 728, 731, 732, 733

[56] References Cited

U.S. PATENT DOCUMENTS

| | | | |
|---|---|---|---|
| 3,993,188 | 11/1976 | Muller | 198/717 |
| 4,254,604 | 3/1981 | Vogel et al. | 53/566 |
| 4,749,079 | 6/1988 | Minto | 198/742 |
| 4,936,077 | 6/1990 | Langen et al. | 53/543 |
| 5,118,409 | 6/1992 | Zaltzman | 209/466 |
| 5,501,318 | 3/1996 | Disrud | 198/732 |
| 5,531,056 | 7/1996 | Liang | 53/252 |

*Primary Examiner*—James F. Coan
*Assistant Examiner*—Gene L. Kim

[57] ABSTRACT

An article packaging machine for packaging articles such as beverage cans into open-ended containers and sealing the containers comprises a carton conveyor that defines a carton path. Open cartons are moved along the path and articles are directed in groups toward and into the cartons as they move along the path. An overhead flight assembly is provided and includes pusher lugs that engage and push the top portions of cartons along the carton path so that the cartons do not become skewed. The spacing between adjacent pusher lugs on the overhead flight assembly is adjusted automatically to accommodate relatively wider cartons or relatively narrower cartons so that human intervention is not required when setting up the machine to package different size cartons.

12 Claims, 5 Drawing Sheets

ARTICLE PACKAGING MACHINE WITH IMPROVED OVERHEAD FLIGHT ASSEMBLY

FIELD OF INVENTION

The present invention relates generally to packaging machines for grouping articles into groups of a predetermined number and directing the groups toward and into open containers, such as preformed paperboard cartons, moving along a carton path. More particularly, the invention concerns the overhead flight and overhead pusher lug assemblies of such machines.

BACKGROUND OF THE INVENTION

Various types of packaging machines or cartoning apparatus are designed to package articles, such as bottles or cans, into a unitary container such as a preformed paperboard carton. Although the ultimate intended goal of these types of packaging machines is the same, that is, to package a desired number of articles in a specific orientation, the methods and apparatus for accomplishing this goal are diverse. Typically, the articles are grouped in some manner to correspond with the approximate container dimensions, and the article group is then transferred into the container. As a final processing step, the container is closed around the article group. Such containers can either be substantially flat, creased carton blanks that are folded around the article group, or partially formed open-ended containers into which the articles are directed through one open end. The container ends are then closed by folding flaps across the open ends and gluing the flaps together. An example of such a packaging machine is disclosed in U.S. Pat. No. 5,546,734, issued Aug. 20, 1996, the specification of which is hereby incorporated by reference.

In many modern packaging machines, open cartons are conveyed along a carton path by an appropriate means such as pairs of upstanding pusher lugs connected to the upper flights of spaced apart endless chain conveyors. The lugs typically extend upwardly between successive cartons on the carton path and are moved along by the endless chain conveyors to push the cartons along the path. As the cartons are conveyed along the carton path, randomly ordered articles are formed into groups by an adjacent infeed conveyor assembly and the grouped articles are moved progressively toward and into the open cartons moving along the carton path. As each carton is filled, its open end is shut and glued together, whereupon the filled carton is discharged from the carton path at the discharge end of the packaging machine.

A common problem with article packaging machines, and with beverage container packaging machines in particular, is that the upper portions of empty preformed open cartons being conveyed along the carton path tend to drag or lag behind the bottom portions, which are held in place and pushed along by the upstanding pusher lugs. This can cause the cartons to become skewed or deformed as they move along the path. As a result, articles cannot be inserted easily into the cartons and, in fact, can impact the skewed cartons causing a machine jam.

To address this problem, many packaging machines employ an overhead pusher lug assembly to support and brace the top portions of cartons as they move along the path. While such overhead pusher lug assemblies vary in detailed operation, in general, they comprise an endless flexible conveyor such as a chain having a lower flight that is positioned above the tops of the cartons and that moves along in synchronization therewith. An array of downwardly projecting lugs are fixed to the chain and extend into the spaces between cartons to engage, support, and push along the top portions of the cartons as they move along the path. As a result, the cartons are maintained in their square undeformed orientations for efficient insertion of articles.

In the past, overhead pusher lug assemblies have exhibited numerous problems and shortcomings. For example, it is desirable that the downwardly projecting lugs of the assembly extend as far as possible into the space between the cartons to provide maximum area of engagement for supporting the top portions of the cartons. Unfortunately, the length of the lugs is naturally limited by the close spacing of the cartons on the conveyor. More specifically, as each lug moves around the drive sprocket at the upstream end of the overhead assembly and onto the lower flight of the conveyor chain, it also moves into position between two adjacent cartons. If the lug is too long or if the carton spacing is a bit less than expected, the lug can impact the top corner of the next trailing carton as it rounds the sprocket, thereby partially crushing or deforming the carton. As a result, the entire packaging machine must be shut down and the deformed carton replaced before the packaging operation can be resumed.

Another problem with prior art overhead pusher lug mechanisms is that they have not been easily adaptable to cartons of different widths and different lengths. In some instances, when setting up the machine for packaging a different size carton, lugs on the overhead pusher lug assembly have to be manually removed and refixed to their conveyor chain at the desired spaced intervals. Obviously, such a procedure is time consuming and requires the knowledge and resources of valuable trained personnel.

Once solution to this problem is disclosed in U.S. patent application Ser. No. 08/271,279 filed Jul. 6, 1994 now U.S. Pat. No. 5,501,318, issued Mar. 26, 1996. In the mechanism of that application, triangular shaped pusher lugs are pivotally attached at spaced intervals along an endless conveyor chain and are releasably lockable in a retracted non-functional orientation wherein they do not project downwardly from the lower flight of their conveyor chain. The pusher lugs are also alternately laterally staggered along the length of the chain. A pair of closely spaced elongated rails are adapted to be lowered from a raised position to a lowered position extending along the lower flight of the chain. Each of the rails is adapted, when in its lowered position, to engage and flip over the pusher lugs of one of the staggered groups of lugs on the conveyor chain. For accommodating wide cartons only one of the rails is lowered and this rail engages lugs of the first staggered group, i.e., every other pusher lug, to flip it over into position for engaging and pushing the tops of cartons as they move along the path. If narrower cartons are being packaged, both of the rails can be lowered and the pusher lugs of both staggered groups are engaged and flipped over by the rails so that each of the shorter cartons are engaged by a corresponding pusher lug.

While the just described configuration is a vast improvement over manually changeable overhead pusher lugs, it nevertheless has its own problems. In particular, the mechanism for raising and lowering the rails is cumbersome and relatively expensive to produce and maintain. In addition, since the lugs must be releasably-lockable in a retracted position, increased mechanical complexity is required and the locking detents machined into each lug can become worn, requiring replacement of the lug. Finally, the elongated rails generally are not adjusted automatically, but must be manually raised and lowered to accommodate different sized cartons.

In many prior art packaging machines, a pair of spaced overhead pusher lug assemblies is provided to engage and push along the top portions of cartons at spaced positions. One problem with such an arrangement is that the spacing between the two overhead assemblies often must be changed manually for adjusting the machine to a different carton size. In addition, the vertical position of the overhead flight assemblies also must be manually adjusted in many prior art machines to accommodate cartons of different heights. All of this manual adjustment requires substantial time and the resources of trained personnel and, further, is subject to human judgment errors and oversights, which can cause machine jams and downtime.

Accordingly, there exists a continuing and heretofore unaddressed need for an efficient, effective overhead flight and pusher lug assembly for packaging machines wherein the size of the individual lugs is not unreasonably limited by the danger of the lugs impacting and deforming cartons as the lugs move around their sprockets and between the cartons on the carton path. A further need exists for an overhead pusher lug assembly wherein the spacings between successive pusher lugs is quickly and easily adjustable to accommodate the packaging of cartons of different widths. In addition, the spacings between the successive pusher lugs should be adjusted automatically as the machine is itself adjusted to accommodate a different width carton. Furthermore, the lateral spacing between each pair of pusher lug assemblies as well as the vertical position of the assembly over the carton path should also be adjusted automatically as the machine is adjusted. It is to the provision of such an overhead flight and pusher lug assembly that the present invention is primarily directed.

SUMMARY OF THE INVENTION

Briefly described, the present invention, in a preferred embodiment thereof, comprises an article packaging machine having an improved automatically adjusted overhead flight and pusher lug assembly for pushing along the upper portions of cartons as the cartons are conveyed along the carton path of the machine. The packaging machine comprises a frame having an upstream end and a downstream end. A carton conveyor is mounted to the frame for conveying cartons sequentially along a predetermined carton path for receiving article groups to be packaged. An infeed conveyor assembly is positioned adjacent and along one side of the carton path for conveying articles along prescribed paths and directing the articles in groups toward open cartons moving along the carton path. The carton path, itself, includes spaced pairs of upstanding pusher lugs that extend upwardly between successive cartons and engage the cartons to push them along the path.

An overhead flight and pusher lug assembly is mounted to the frame. This assembly comprises a pair of spaced apart elongated cam plates that are vertically oriented and that have bottom edges extending along and above the carton path. An endless chain conveyor extends around the periphery of each cam plate and around sprockets mounted on either end of the plate. At least one of the sprockets on each cam plate is driven to move the endless chain around the periphery of the cam plate. The lower flights of the endless chain conveyors extend generally along the lower edge portions of their respective cam plates and the sprockets are driven in such a direction that these lower flights move along in the direction of carton movement with the speed of the lower flights being synchronized with the speed of the cartons.

A first set of generally triangular pusher lugs are pivotally attached at spaced intervals along each of the endless chain conveyors. Each of these lugs can be pivoted to a first non-operative position extending generally along the chain and a second operative position projecting downwardly from the lower flight of the chain for engaging and pushing cartons moving along the path. Each cam plate is machined or contoured to provide a cam surface that extends along the bottom portion of the cam plate. As the first set of pusher lugs round their sprocket on the upstream end of the assembly, they engage the cam surface and are pivoted or flipped over thereby to their second or downwardly projecting positions to engage and push along the upper portions of cartons moving along the path. The upstream end of the cam surface is positioned so that the pusher lugs are flipped to their downwardly projecting orientations in such a way that they do not impact and deform the tops of trailing cartons on the path. Similarly, the downstream end of the cam surface is positioned to release the pusher lugs just before they begin to round the downstream sprocket. In this way, the lugs are released to swing freely back to their first positions before they round the downstream end of the cam plate to prevent the lugs from giving the top portions of cartons an undesirable push or shove as they begin to round the sprocket.

A second set of pusher lug assemblies are mounted at spaced intervals to each of the endless conveyor chains and, preferably, are spaced half way between each pair of first pusher lugs on the chain. Each of the second pusher lugs assemblies comprises a slotted bracket that is mounted directly to the endless conveyor chain. An elongated finger is mounted in the vertical slot of each bracket and slidable within the slot between a first position projecting downwardly from the lower flight of the chain and second or raised position wherein the finger is retracted above the lower extent of the cam plate.

The cam plate is machined to define a cam track that extends around the cam plate spaced from the peripheral edges thereof. The cam track has a single upper leg and has a lower leg that includes two vertically spaced races. Each of the slidable fingers of the second pusher lug assemblies is provided with an inwardly extending cam pin or cam follower that fits and rides in the cam track of the cam plate. Thus, the fingers of the second pusher lug assemblies are held in place within the slots of their brackets by their cam follower pins extending into and riding within the cam track.

As the second pusher lug assemblies ride along the lower flight of their endless conveyor chain, the cam pins of their fingers can be positioned in either one of the vertically spaced races of the lower leg of the cam track. When the lugs ride in the upper race, the fingers of the second pusher lug assemblies are held in a retracted, non-operative position wherein they do not extend below the assembly and thus do not engage cartons on the path. Alternatively, when the cam pins of the fingers of the second pusher lug assemblies ride in the lower race, they are held in an extended position wherein the fingers project downwardly below the assembly for engaging and pushing cartons along the path. When the fingers of the second pusher lug assemblies are extended downwardly, the machine is in condition for conveying cartons of a relatively narrow width and the cartons are engaged alternately by the first pusher lugs and the downwardly projecting fingers of the second pusher lug assemblies. Conversely, when the fingers are in their retracted positions, the machine is adjusted for conveying cartons of a relatively wider width and the cartons are engaged only by the first pusher lugs.

A switch gate is provided on the cam plate at the upstream end thereof. The switch gate functions in a manner similar to the switch of a railroad track. Specifically, the plate is movable between a raised positioned and a lowered position and is formed with a pair of alternate switch tracks. When the switch gate is in its raised position, it directs the cam pins of the fingers of the second pusher lug assemblies into the upper race of the lower leg of the cam track. Thus, the fingers are not extended and the machine is adjusted for wide cartons. When the switch gate is in its lowered position, it directs the cam follower lugs of the fingers into the lower race of the cam track so that the fingers are extended to project downwardly to their operative positions. A pneumatic cylinder is provided to move the switch gate between its first and second positions and is actuated automatically when the machine is adjusted for different sized cartons. In this way, the spacing between successive downwardly extending pusher lugs of the assembly is set automatically to accommodate either narrower or wider cartons upon adjustment of the machine.

The spaced cam plates of the overhead pusher lug assemblies are mounted to respective metal side plates. These metal side plates are coupled together by a pair of horizontally movable scissor jack extenders that can be activated to adjust the spacing between the plates. The scissor jack extenders are also provided with hydraulic cylinders that, when actuated, extend or retract the scissor jack extenders to adjust the transverse spacing between the cam plates and thus the spacing between the pairs of downwardly extending pusher lugs. These pneumatic cylinders are actuated automatically when the machine is adjusted for different size cartons so that the spacing between the two cam plates is adjusted automatically upon adjustment of the machine. The spacing can also be adjusted manually if desired.

In addition, both of the side plates to which the cam plates are attached are mounted to the frame of the machine from above on a pair of vertically movable scissor jack extenders. Pneumatic cylinders are provided to extend and retract these scissor jack extenders to adjust the vertical position of the plates and thus the vertical position of the entire overhead pusher lug assembly above the carton path to accommodate cartons of different heights and to raise the assembly for machine maintenance.

Thus, it is seen that an article packaging machine is now provided that addresses the problems and shortcomings of the prior art. Specifically, the machine includes an overhead flight and pusher lug assembly wherein the spacings between the successive lugs can be set automatically when the machine is adjusted to accommodate cartons of different sizes. In addition, the transverse spacing between each pair of pusher lug assemblies can also be automatically set when the machine is adjusted for packaging different size cartons. Finally, the vertical position of the entire assembly can be adjusted easily and automatically to raise it out of the way for maintenance or to adjust it for cartons of different height. All of these functions are pneumatically controlled so that very little additional time is required to set up the machine for packaging a new size carton. In addition, the cam track arrangement for raising and lowering the second set of pusher lugs is uncomplicated, has a minimum of moving parts, and is therefore reliable for long periods of time. These and other objects, features, and advantages of the invention will become more apparent upon review of the detailed description set forth below when taken in conjunction with the accompanying drawings, which are briefly described as follows.

DETAILED DESCRIPTION OF THE PREFERRED EMBODIMENT

Figure 1:
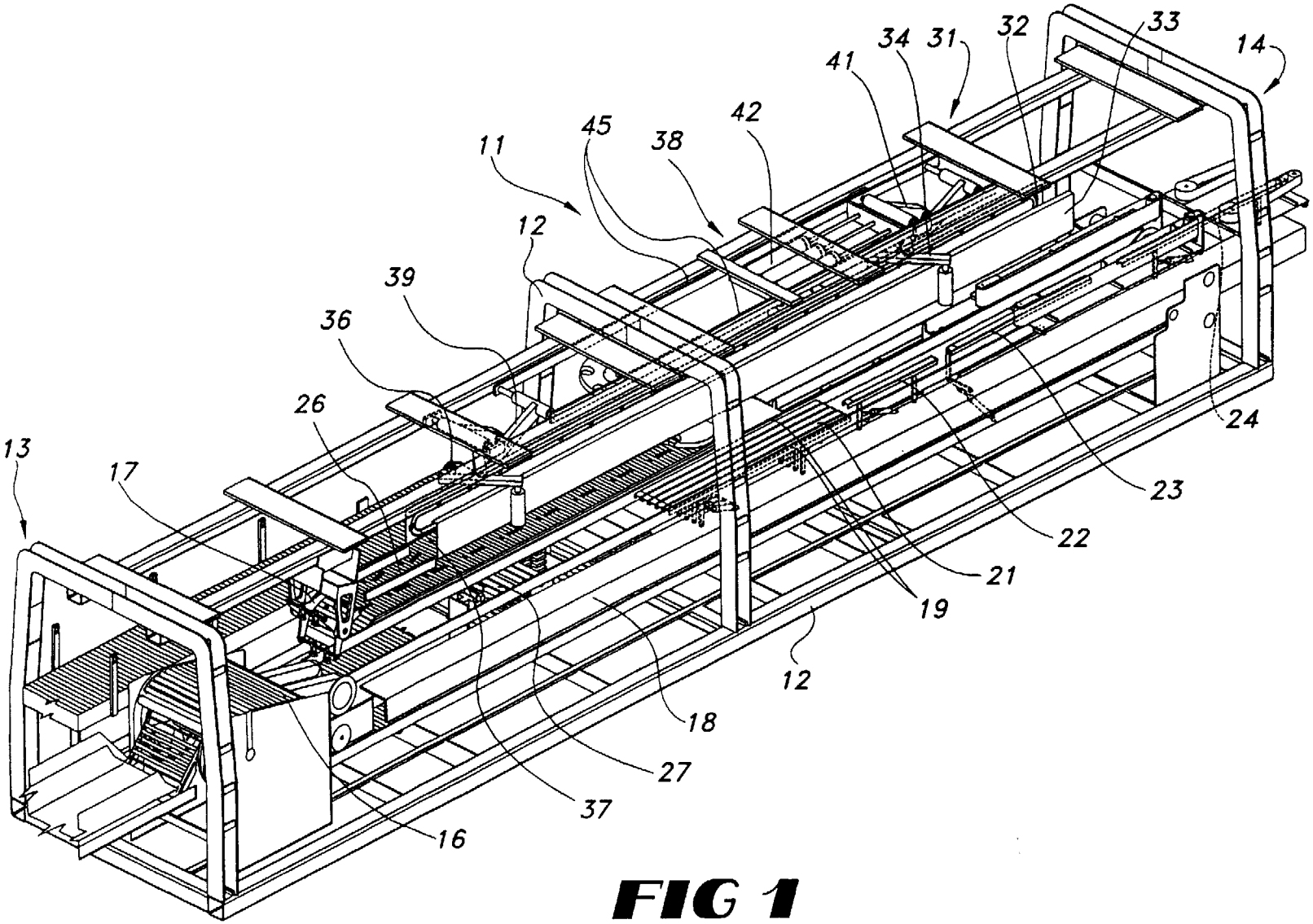
FIG. 1 is a perspective view of an article packaging machine that embodies principles of the present invention in a preferred form. Elements of the machine most pertinent to the invention are shown in solid line, while other elements are shown in phantom line for clarity.

Referring now in more detail to the drawings, in which like numerals refer to like parts throughout the several views, FIG. 1 illustrates in perspective form an article packaging machine that embodies principles of the invention in a preferred form. The packaging machine 11 has a walk-in frame 12 that supports the various functional elements of the machine and that provides overhead structure for supporting a retractable enclosure (not shown). The machine 11 has an infeed end 13 and a discharge end 14. A carton magazine assembly 16 functions to feed cardboard containers or cartons successively to the machine for subsequent packaging with articles. Typically, the cartons or containers are fed by the carton magazine assembly 16 in a flattened or unopened configuration. A carton opening station 17 has a carton feed opening wheel with at least one suction cup thereon that engages the flattened cartons and pulls them open for delivery to the carton path of the machine, where the cartons are conveyed along the machine for packaging and closing.

An elongated carton transport conveyor 18, extends along the machine to the discharge end thereof and defines a carton path along which the cartons move. The carton transport conveyor 18 has a pair of spaced pusher lug guide rails 19 extending along and defining the edges of the carton path. The guide rails support spaced upstanding pairs of pusher lugs that are moved along the rails by respective endless conveyor chains. When moving along the carton path, the opposed ends of the cartons rest upon the guide rails and the body of the cartons extend across and span the space between the guide rails. As the pusher lugs are moved along the guide rails, they engage the cartons adjacent their opposed ends and push them successively along the rails and along the carton path to the right in FIG. 1.

Bed plate assemblies 21, 22, 23, and 24 comprise sets of elongated bed plates or rails that can be positioned in the gap between the guide rails to support the midportions of cartons that span the gap as the cartons are conveyed along the carton path. In the preferred embodiment, these bed plates are mounted for articulated motion between raised positions wherein the bed plates are located in the path and lowered positions wherein they are displaced from the path. This allows the proper number of bed plates to be raised into position depending upon the adjusted width of the carton path to provide appropriate support for the mid-sections of cartons moving along the path.

A selector belt conveyor assembly 26 is mounted to the frame adjacent the carton path and is driven to move along, and beside, the path, to the right in FIG. 1. The conveyor assembly 18 includes a spaced series of selector wedges (not shown) and other functional elements that group articles into groups of a predetermined size and direct the article groups toward and into open cartons moving along the adjacent carton path. The configuration and function of these selector wedges in conjunction with the conveyor assembly 18 is described in detail in copending application Ser. No. 08/118,111, and that description is hereby incorporated by reference. Unused selector wedges 27 are stowed in an out-of-the way position in the machine so that appropriate selector wedges can be selected and installed for grouping articles into groups of various desired number and size.

An overhead flight assembly, generally indicated at 31, is mounted to the frame above the carton transport conveyor 18 and the carton path defined thereby. The overhead flight assembly 31 comprises a first side plate 32 and a second side plate 33. The side plates 32 and 33 are configured as elongated metal plates and are positioned in spaced parallel relationship extending along and above the carton path. The side plates 32 and 33 are connected together by a first horizontal scissor jack extender 34 located toward the downstream end of the packaging machine and a similar second horizontal scissor jack extender 36 located toward the upstream end of the machine. These scissor jack assemblies and their function are described in more detail below. In general, however, the horizontal scissor jack extenders 34 and 36 function to hold the side plates 32 and 33 in their spaced parallel relationship and to provide a simple and automatic means of adjusting the spacing between the plates.

An elongated cam plate and endless conveyor chain assembly 37 is attached to the inner surface of each of the side plates 32 and 33. As discussed below, the cam plates 37 support the endless chain conveyors that carry and transport the pusher lugs for engaging and pushing the upper portions of cartons moving along the carton path.

An overhead vertically oriented scissor jack assembly, generally indicated at 38, is mounted to the upper portion of the frame 12. This assembly functions to support the side plates 32 and 33 and their associated cam plates and other functional elements above the carton path and to provide a convenient means of raising and lowering the plates and pusher lug assemblies. In general, the overhead vertical scissor jack assembly 38 comprises a first vertical scissor jack extender 39 toward the upstream end of the machine and a second vertical scissor jack extender 41 toward the downstream end of the machine. A set of pneumatic cylinders 42 are coupled to the second scissor jack extender to raise and lower the extender upon appropriate actuation of the pneumatic cylinders. The second scissor jack extender 41 is coupled through coupling rails 45 to the first vertical scissor jack extender 39. In this way, when the second scissor jack extender 41 is raised or lowered by the pneumatic cylinders 42, this action is transmitted to the first scissor jack extender 39, which raises or lowers in unison with the second scissor jack extender.

The main arm of each of the vertical scissor jack extenders is attached at its lower end to the side plate 32. Accordingly, it will be seen that raising or lowering the scissor jack extenders by means of the hydraulic cylinders 42 functions to raise and lower the side plates 32 and 33 along with the cam plates and other elements attached to the side plates. Accordingly, the vertical position of the pusher lug assembly is adjustable by means of the overhead vertical scissor jack assembly 38 and the horizontal spacing between the side plates 32 and 33 is adjustable by means of the horizontal scissor jack extenders 34 and 36. In the preferred embodiment, the pneumatic cylinders that operate the various scissor jack extenders are coupled to the control mechanism of the machine so that the extenders can be adjusted automatically to set the vertical position and the horizontal spacing of the pusher lug assembly when the machine is adjusted to accommodate cartons of different sizes.

Figure 2:
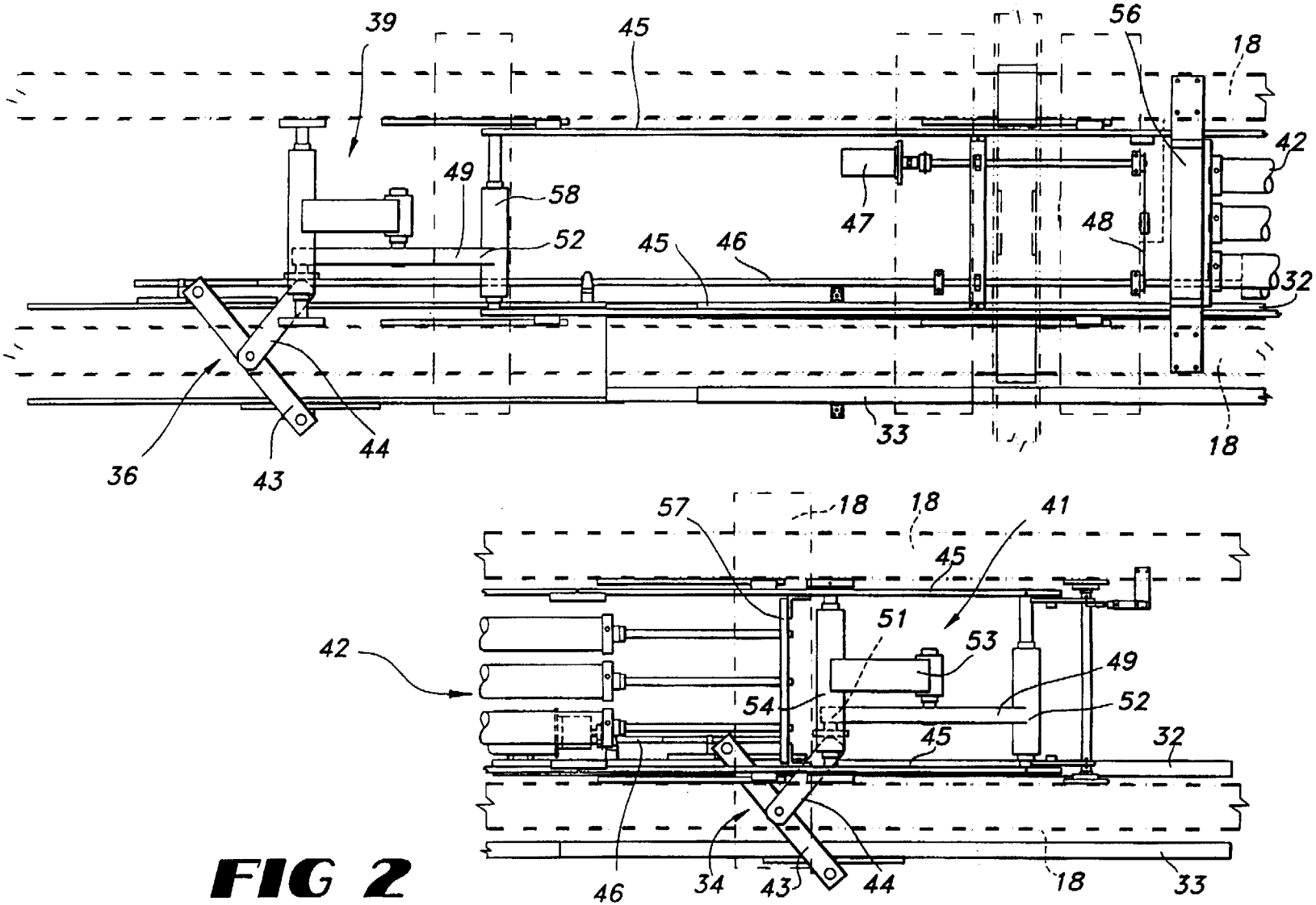
FIG. 2 is a top plan view of the improved overhead flight and pusher lug assembly of this invention illustrating placement and operation of the scissor jack extenders for adjusting the transverse spacing and vertical position of the assembly.

FIG. 2 is a top plan view of the machine of FIG. 1 illustrating in more detail the vertical and horizontal scissor jack assemblies. Here, the frame 18 of the packaging machine is illustrated in phantom lines for clarity. The first and second side plates 32 and 33 are seen from the top in FIG. 2. The horizontal scissor jack extenders 34 and 36 are each seen to include a main arm 43 and a stabilizer arm 44. The main arm 43 is movably coupled by appropriate bushings at its ends to the first and second side plates 32 and 33. The stabilizer arm 44 is coupled at its lower end in FIG. 2 to the main arm 43 intermediate the ends of the main arm. The other end of the stabilizer arm 44 is pivotally mounted to the frame of the machine. An elongated threaded rod 46 is threadably coupled at its ends to a threaded screw block that, in turn, is connected to the upper end portions of the main arms of scissor jack extenders 34 and 36. The threaded rod 46 is adapted to be rotated in either direction by an appropriate motor 47 coupled to the threaded rod by means of a drive chain 48.

The threads of the threaded rod 46 are arranged so that when the rod is rotated in one direction, the upper ends (as seen in the view of FIG. 2) of the horizontal scissor jack extenders are moved to the left in FIG. 2. Conversely, when the threaded rod 46 is rotated in the other direction, the upper ends of main arms 43 of the horizontal scissor jack extenders are moved to the left. With this arrangement, it will be seen that the horizontal spacing between the first side plate 32 and the second side plate 33 can be adjusted by rotation of the threaded rod 46, which extends and retracts the horizontal scissor jack extenders 34 and 36 in unison with each other to move the side plates apart or together as the case may be.

The overhead or vertical scissor jack assembly 38 functions in a manner similar to the horizontal scissor jack extenders. Specifically, a first vertical scissor jack extender 41 includes a main arm 49 that is rotatably coupled by appropriate bushings at its bottom end 51 to the first side plate 32 and is rotatably coupled by appropriate bushings at its top end 52 to coupling rails 45. A stabilizer arm 53 is pivotally coupled by a bushing at its lower end to the mid section of main arm 49 and is pivotably coupled through bushing assembly 54 to the frame 18 of the packaging machine.

Pneumatic cylinders 42 are attached at their left end in FIG. 2 to the frame 18 by means of a mounting bracket 56. The other ends of the pneumatic cylinders 42 are attached by bracket assembly 57 to the coupling rails 45. The coupling rails 45 are attached through bushing assembly 58 to the upper end 52 of the main arm 49 of the first vertical scissor jack extender 39. The first vertical scissor jack extender 39 is configured and connected in the same way as the second vertical scissor jack extender 41 and will thus not be described in detail; however, it will be understood that this assembly functions the same as the assembly 41.

With the just described arrangement, it will be seen that when the pneumatic cylinders 42 are extended, the upper ends 52 of the main arms 49 of vertical scissor jack extenders 39 and 41 are moved to the right in FIG. 2. This functions to raise the side plates 32 and 33 relative to the carton path of the machine. Conversely, retraction of the pneumatic cylinders 42 moves the tops of the upper arms 49 of assemblies 39 and 41 to the left in FIG. 2. This has the effect of lowering the side plates 32 and 33 relative to the carton path of the machine. Accordingly, appropriate manipulation of the pneumatic cylinders 42 functions to adjust the vertical position of the side plates 32 and 33 and thus the vertical position of the overhead pusher lug assembly.

Figure 3:
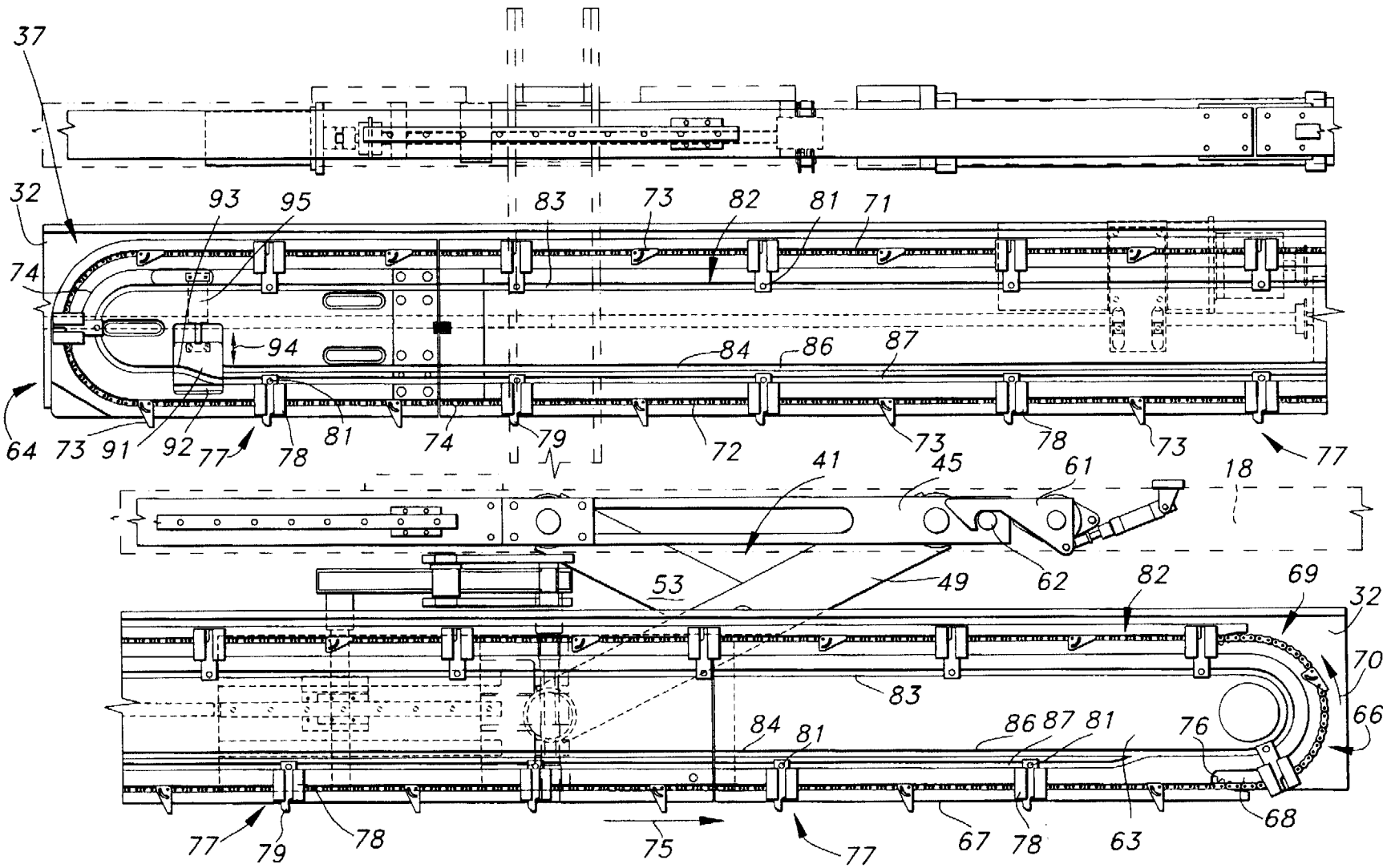
FIG. 3 is a side elevational view of one of the cam plates of the assembly illustrating the endless chain conveyor and the pusher lugs attached thereto.

FIG. 3 is a side elevational view of the first side plate 32 from the inside thereof showing the cam plate 37 and its associated pusher lugs and endless conveyor chain assemblies. In FIG. 3, the second vertical scissor jack extender 41 is shown mounting the first side plate 32 to the frame 18 of the machine. A safety latch 61 is attached to the frame and is adapted to engage a latch pin 62 attached to the coupler rail 45 when the rail is extended fully to the right in FIG. 3. Accordingly, when the coupler rail is extended fully to the right so that the vertical scissor jack extenders are fully retracted and the side plates 32 and 33 are raised up for machine maintenance, the safety latch 61 engages the latch pin 62 to ensure that the assembly does not fall back down and injure a worker working on the machine.

The cam plate assembly attached to side plate 33 and its operation will now be described. It will be understood that the same description applies to the other cam plate assembly attached to side plate 33 and that the two assemblies are mirror images of each other and are configured and function in the same way.

Cam plate assembly 37 comprises an elongated cam plate 63 that, preferably, is machined of plastic, teflon®, or other durable material that is easily worked. The cam plate 63 is mounted to the side plate 32 and extends therealong in generally vertical orientation. Cam plate assembly 37 has an upstream end 64 and a downstream end 66. The cam plate 63 also has a bottom edge 67 that protrudes slightly below the bottom of side plate 32 and that extends substantially along the length of the side plate.

A sprocket 68 is rotatably secured to the downstream end 66 of the cam plate and a corresponding sprocket (not visible in FIG. 3) is rotatably secured to the upstream end 64 of the cam plate. An endless chain conveyor 69 extends around the sprockets at the end of the cam plate. The chain conveyor 69 has an upper flight 71 and a lower flight 72. A chain track is machined along the top and bottom edges of the cam plate 63 and the endless chain 69 rides in and is movably secured by the chain tracks. At least one of the sprockets is driven to move the endless chain conveyor 69 in the direction indicated by arrows 70. In this way, the lower flight of the endless chain conveyor 69 is moved in direction 75. Furthermore, the drive mechanism that moves the chain is configured to synchronize the speed of the lower flight of the chain with the speed of cartons moving along the carton path. Accordingly, the lower flight of the chain moves along in direction 75 in synchronization with cartons moving along the carton path.

A set of first generally triangular pusher lugs 73 are each pivotally attached to the endless conveyor chain 69 at spaced apart locations therealong. Each of the first pusher lugs 73 is attached to the endless chain 69 by means of a pivot pin. In this way, each lug 73 can pivot to a retracted position, as shown along the upper flight of the chain in FIG. 3, wherein the pusher lug extends generally along the direction of the chain. Alternatively, each lug can pivot to an extended position as shown along the lower flight of the chain in FIG. 3 wherein the lug projects downwardly from the chain to a position below the lower edge 67 of the cam plate 63.

The cam plate 63 is machined or otherwise formed with a lip 74 that extends at least along the bottom edge portion of the cam plate adjacent to the lower flight of the chain. The lip is positioned so that, as the first pusher lugs 73 round the sprocket at the upstream end of the cam plate, they are engaged by the lip 74, causing the pusher lugs to pivot from the retracted position that they were in along the upper flight of the chain to their extended positions for movement along the lower flight of the chain. At the downstream end of the cam plate 63 adjacent the sprocket 68, the lip is contoured to release each of the pusher lugs 73 just before it begins to move around the sprocket 68. In this way, each pusher lug is free to rotate back to its retracted position as it moves around the sprocket. In addition, the lug is released before it begins its upward motion around the sprocket. This ensures that the lug does not give the top of its carton an undesirable kick as it begins to move up and around the sprocket.

A set of second pusher lug assemblies, generally indicated at 77, are also attached at spaced intervals to the endless conveyor chain 69. In the preferred embodiment, these second pusher lug assemblies 77 are fixed to the chain midway between each of the successive first pusher lugs 73. Each of the second pusher lug assemblies 77 includes a vertically slotted bracket 78 that is fixed to the chain 69. Each bracket is machined or otherwise formed with a T-shaped slot. A finger 79 is slidably mounted in the T-shaped slot of each bracket 78. In this way, the fingers 79 can slide within the slots of their respective brackets between retracted positions, as shown along the upper flight of the endless chain in FIG. 3, and extended positions, as shown along the lower flight.

Each of the slidable fingers 79 has a cam pin 81 that is fixed to the end of the finger and extends inwardly therefrom into the page in FIG. 3. A corresponding cam track 82 is machined or otherwise formed in the cam plate 63 and extends therearound at a position spaced from the peripheral edges of the cam plate. The cam track 82 has an upper leg 83 that extends adjacent the upper edge of the cam plate and a lower leg 84 that extends adjacent the lower edge of the cam plate. The upper leg 83 of the cam track has a single race while the lower leg 84 of the cam track has two vertically spaced apart parallel races 86 and 87. The track 82 receives the cam pins 81 of the fingers 79. Thus, each of the fingers is held in a predetermined position within the slot of its bracket by the cooperation of its cam pin with cam track.

The upper leg 83 of the cam track 82 is spaced from the top edge of the cam plate 63 so that, as the second pusher lug assemblies 77 move along the top portion of the cam plate, the fingers 79 are held in their retracted positions within the slots of their brackets as shown. Thus, when being moved along the top flight of the endless conveyor chain 69, the fingers of the second pusher lug assemblies are retracted and do not protrude from the assembly.

The lower leg of the cam track 82 is provided with two vertically spaced races 86 and 87. The upper race 86 is spaced from the lower edge of the cam plate 63 so that when the cam pins 81 of the finger 79 ride in the upper race 86, the fingers 79 are retracted just as they are along the upper flight of the endless chain 69. However, when the cam pins 81 extend into and ride in the lower race 87, the fingers 79 are held in their extended positions with their lower ends projecting below the lower edge of the cam plate 63 as shown in FIG. 3. Thus, when the cam pins ride along in the lower race 87 as shown in FIG. 3, the fingers are extended to their operative positions wherein they engage and push along the upper portions of cartons moving along the carton path. Conversely, when the cam pins ride in the upper race 86, the fingers 79 are retracted and do not engage cartons moving along the path.

In practice, standard cartons are available in two widths; one width corresponding to two beverage cans packed across the width of the container and the other corresponding to four beverage cans packed across the width. Thus, the latter standard carton is twice as wide as the former. To accommodate these standard carton sizes, the first pusher lugs 73 are spaced along the chain at locations to engage and push the wider cartons. When the fingers 79 of the second pusher lug assemblies 77 are extended downwardly as shown in FIG. 3, the machine is set up to package the relatively narrower cartons. In this configuration, one of the first pusher lugs 73 engages a carton on the carton path and the extended finger 79 of the next trailing pusher lug assembly 77 engages the next trailing carton on the path. Thus, the fingers 79 are extended when the narrower cartons are to be packaged and retracted when the wider cartons are to be packaged.

A switch gage 91 is mounted to the cam plate 63 at the upstream end thereof. The switch gate 91 is generally rectangular in shape and is machined or otherwise formed with a pair of alternative tracks that are positioned to align with the cam track 82. The lower track 92 of the switch gate 91 extends straight across the gate. The upper track 93, on the other hand, extends across the switch gate at a skewed angle. The switch gate is slidable within a slot in the cam plate 63 vertically in the direction shown by arrow 94. As can be seen in FIG. 3, when the switch gate 91 is in its lowered position, the skewed or upper track 93 directs the cam pins 81 of fingers 79 into the lower race 87 of the lower leg of the cam track 82. Conversely, when the switch gate 91 is in its raised position within its slot, the straight across track 92 aligns with the upper race 84 and directs the cam pins 81 into the upper race.

Thus, the switch gate 91 functions to direct the cam pins 81 either into the lower race 87, wherein the fingers 79 are extended, or into the upper race 86, wherein the fingers 79 are retracted. The entire pusher lug assembly can thus be adjusted for narrower or wider cartons simply by moving the switch gate 91 to position the cam pins 81 into the proper race. In practice, a pneumatic cylinder 95 is coupled to the switch gate 91 and is controlled by the machine controller to raise and lower the switch gate as necessary. Preferably, the pneumatic cylinder 95 is actuated automatically when the machine is adjusted to accommodate a particular size carton so that the pusher lug assemblies are adjusted instantly and automatically without additional human intervention.

Figure 4:
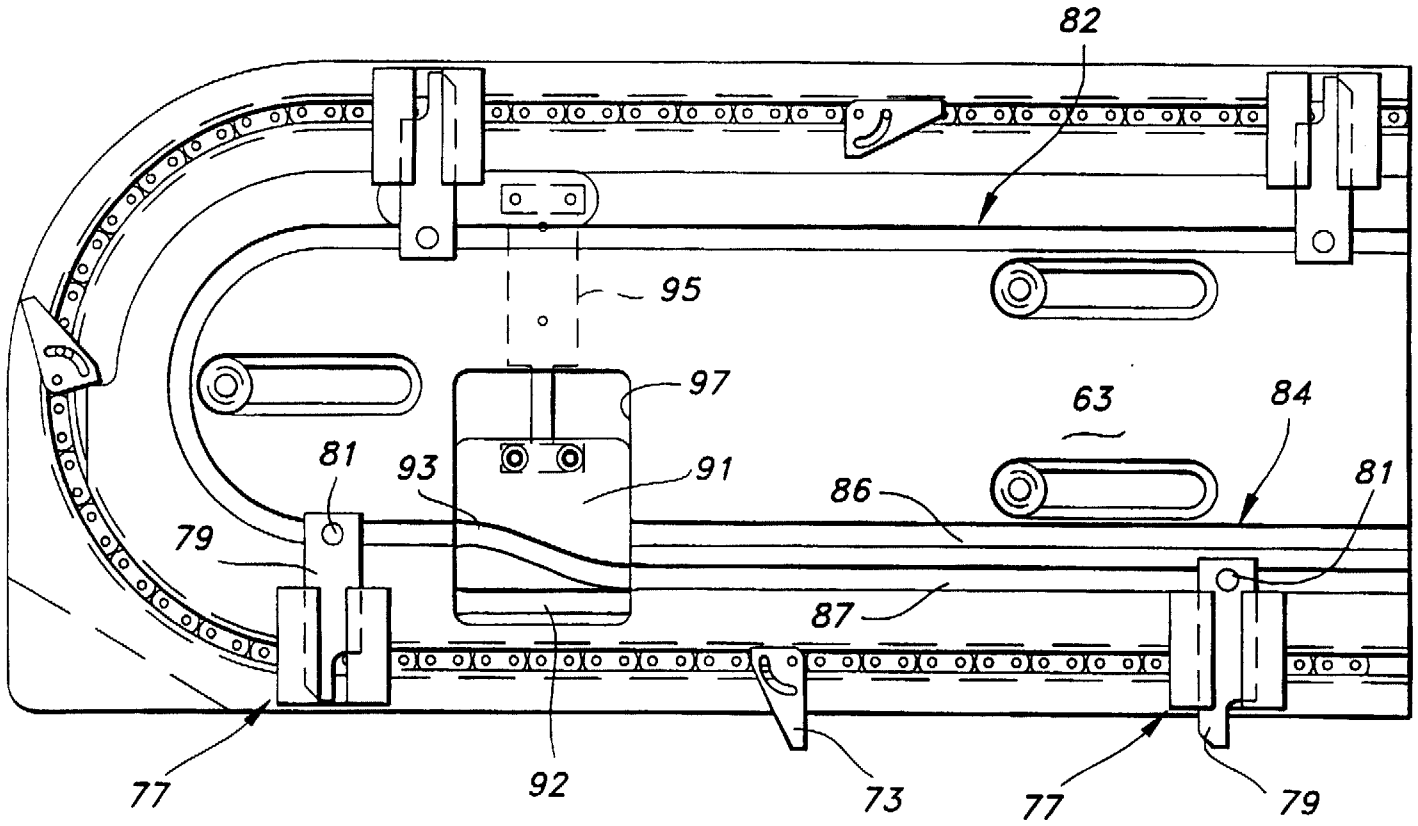
FIG. 4 is an enlarged side elevational view of the downstream end of the cam plate shown in FIG. 3 illustrating operation of the switch gate and showing the switch gate in its first position for extending the fingers of the second set of pusher lug assemblies to their operational positions.

FIG. 4 is an enlarged view of the upstream end of the cam plate 63 illustrating better the operation of the switch gate 91. In FIG. 4, the pneumatic cylinder 95 is shown extended to position the switch gate 91 in its lowered position within slot 97. In this position, the upper track 93 of the gate 91 receives cam pins 81 from the left in FIG. 4 and directs them along track 93 into the lower race 87 of the cam track bottom leg 84. Accordingly, this is the position of the switch gate 91 that extends the fingers 79 to accommodate relatively narrower cartons.

Figure 5:
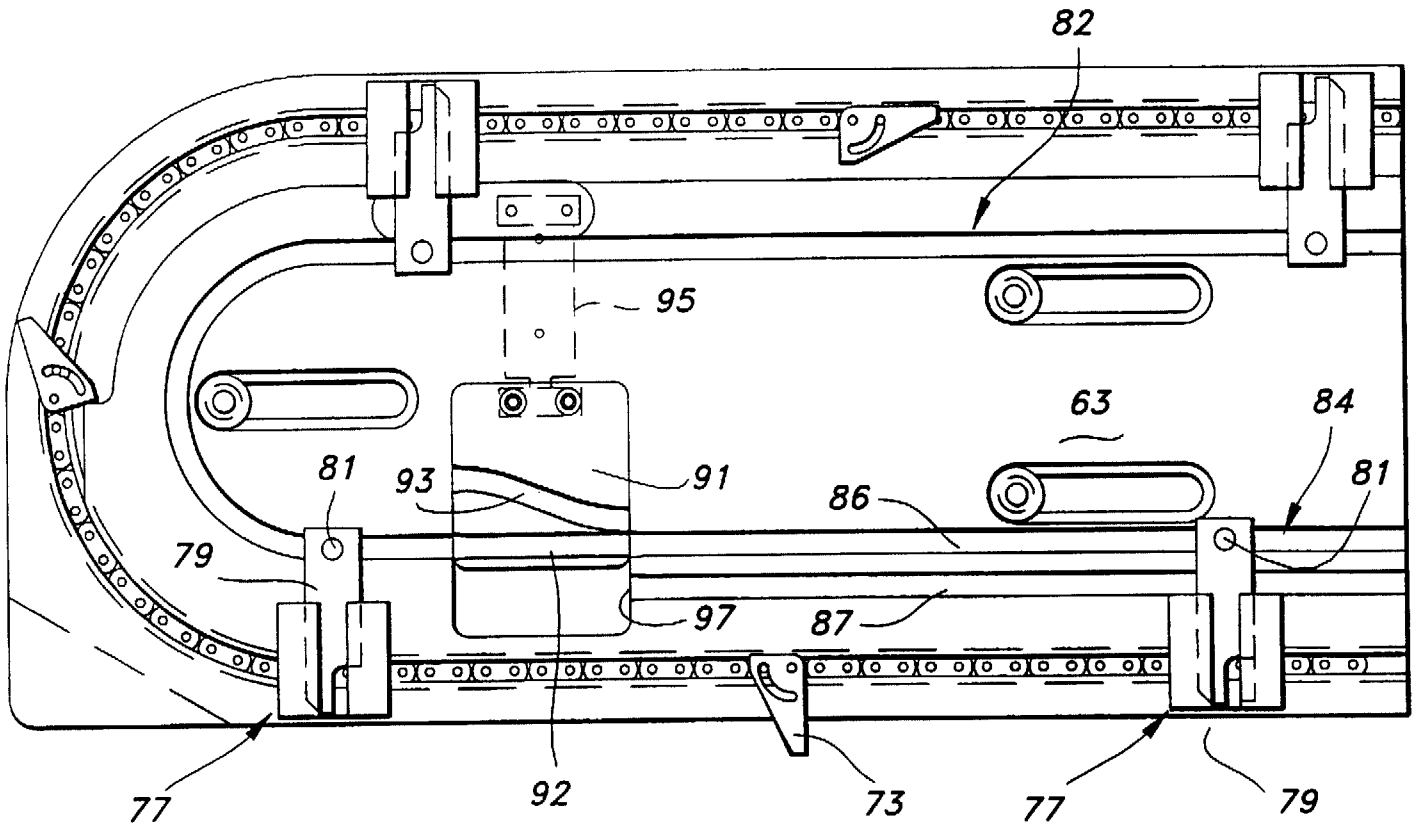
FIG. 5 is also an enlarged view of the upstream end of the cam plate showing the switch plate in its second position for locating the fingers of the second pusher lug assemblies in their inoperative positions.

FIG. 5 shows the orientation of the switch gate 91 for accommodating relatively wider cartons. Here, the pneumatic cylinder 95 is shown retracted, which positions the switch gate 91 in its upper position within the slot 97. In this position, the track 92 receives cam pins 81 from the left and directs them directly across the switch gate 91 and into the upper race 86 of the cam track's lower leg 84. Thus, when the switch gate 91 is positioned as shown in FIG. 5, the fingers 79 are retracted when moving along the bottom of the cam plate and the machine is adjusted to accommodate the packaging of relatively wider cartons. As mentioned above, the pneumatic cylinder 95 preferably is controlled by an appropriate computer-based controller that sets the position of the switch gate 91 automatically when the machine is adjusted for one or the other size cartons.

The invention has been described herein in terms of preferred embodiments and methodologies. It will be obvious to those of skill in the art, however, that various additions, deletions, and modifications might well be made to the illustrated embodiments without departing from the spirit and scope of the invention as set forth in the claims.

I claim:

1. An article packaging machine for packaging articles of a first size and a second size, such as bottles or cans into cardboard containers, said packaging machine comprising:

a frame;

carton conveyor means mounted to said frame for conveying cartons along a predetermined carton path;

an infeed conveyor assembly on one side of said carton path for conveying articles along prescribed paths and directing the articles in groups toward open cartons moving along said carton path;

an overhead flight assembly including an endless conveyor having an upper flight and a lower flight with said lower flight of said endless conveyor being positioned to overlie cartons on said carton path and being oriented substantially along the direction of carton movement;

said endless conveyor having an upstream end and a downstream end and being driven to move said lower flight of said endless conveyor from said upstream end to said downstream end at a rate synchronized with the rate at which cartons are conveyed along said carton path;

an array of pusher lug assemblies mounted at spaced intervals along the length of said endless conveyor for engaging and pushing along the upper portions of cartons being conveyed along said carton path;

said endless conveyor including first and second sets of aligned pusher lug assemblies, where each said set of pusher lug assemblies have fingers that are retracted as said pusher lug assemblies pass over said upper flight, and that only said second set includes fingers that are operably retractable as they pass over said lower flight; and means for selectively extending said fingers of said second set when cartons of said second size are being conveyed along said carton path and retracting said fingers of said second set when cartons of said first size are being conveyed along said carton path.

2. An article packaging machine as claimed in claim 1 and further comprising means for selectively adjusting the vertical position of said flight assembly to accommodate cartons of varying height and to accommodate maintenance of said packaging machine.

3. An article packaging machine as claimed in claim 2 and wherein said means for selectively adjusting the vertical position of said flight assembly comprises a pair of spaced scissor jack extenders mounted to said frame and said flight assembly and means for manipulating said scissor jack extenders for selective vertical adjustment of said flight assembly.

4. An article packaging machine as claimed in claim 1 and wherein said overhead flight assembly includes a pair of endless conveyors arranged in transversely spaced relationship with respect to said carton path, each of said endless conveyors having a lower flight provided with spaced apart pusher lug assemblies for engaging the upper portions of cartons at spaced positions for pushing the cartons along the carton path.

5. An article packaging machine as claimed in claim 4 and further comprising means for selectively adjusting the spacing between said endless conveyors to accommodate cartons of different sizes.

6. An article packaging machine as claimed in claim 1 and wherein alternate ones of said pusher lug assemblies comprise said first set, and the remaining said pusher lug assemblies comprise said second set.

7. An article packaging machine as claimed in claim 1 and wherein each of said fingers of said second set includes a cam and wherein said overhead flight assembly is provided with first and second cam tracks positioned so that said fingers of said second set are maintained in their retracted positions when their cams ride in said first cam track and are maintained in their extended positions when their cams ride in said second cam track, said means for selectively extending and retracting said fingers of said second set comprising means for selectively locating said cams of said fingers of said second set in said first cam track or said second cam track.

8. An article packaging machine as claimed in claim 7 and wherein said switching means comprises a switch gate having a first position directing said cams into said first cam track and a second position directing said cams into said second cam track and means for selectively moving said switch gate between its first and second positions.

9. An overhead pusher lug assembly for an article packaging machine wherein cartons to be packed with articles are moved sequentially along a carton path, said overhead pusher lug assembly comprising:

an elongated cam plate having a top edge and a bottom edge, said cam plate being positioned above said carton path with its bottom edge extending therealong;

an endless flexible conveyor having an upper flight and lower flight extending along said cam plate adjacent said bottom edge thereof, said lower flight of said endless conveyor being positioned to overlie cartons on said carton path and being oriented substantially along the direction of carton movement;

a plurality of fingers, where alternate fingers comprise a first set and the remaining fingers comprise a second set coupled to said endless flexible conveyor for movement therewith, where said fingers of said second set have an extended position wherein said fingers of said second set extend below said lower edge of said cam plate for engaging and pushing the upper portions of cartons moving along the carton path as the fingers of said second set pass over said lower flight of said endless flexible conveyor and a retracted position wherein said fingers of said second set do not engage cartons moving along the carton path by passing over said upper flight; and means for selectively locating said fingers of said second set in their extended positions or their retracted positions.

10. An overhead pusher lug assembly as claimed in claim 9 and wherein said means for selectively locating said fingers of said second set comprises a cam on each of said fingers of said second set and a pair of spaced cam tracks formed in and extending along said cam plate, said cam tracks being sized and configured to receive said cams as said fingers of said second set move along said flight of said endless flexible conveyor, said fingers of said second set being held in their retracted positions when said cams are located in one of said cam tracks and said fingers of said second set being held in their extended positions when said cams are located in the other one of said cam tracks, and means for selectively locating said cams in a selected one of said cam tracks.

11. An overhead pusher lug assembly as claimed in claim 10 and wherein said means for selectively locating said cams in a selected one of said cam tracks comprises a switch gate on said cam plate in the path of said cam tracks, said switch gate having a first position wherein said cams are directed into one of said cam tracks as they traverse said switch gate and a second position wherein said cams are directed into the other one of said cam tracks as they traverse said switch gate, and means for selectively moving said switch gate between its first and second positions.

12. An overhead pusher lug assembly as claimed in claim 11 and wherein said means for selectively moving said switch gate comprises a pneumatic cylinder coupled to said switch gate.

* * * * *